US005179365A

United States Patent [19]

Raggi

[11] Patent Number: 5,179,365

[45] Date of Patent: Jan. 12, 1993

[54] MULTIPLE TURN LOW PROFILE MAGNETIC COMPONENT USING SHEET WINDINGS

[75] Inventor: Emil J. Raggi, Garland, Tex.

[73] Assignee: AT&T Bell Laboratories, Murray Hill, N.J.

[21] Appl. No.: 459,037

[22] Filed: Dec. 29, 1989

[51] Int. Cl.[5] ..... H01F 15/02; H01F 27/30

[52] U.S. Cl. ..... 336/65; 336/83; 336/192; 336/198; 336/223

[58] Field of Search ..... 336/83, 65, 223, 232, 336/200, 198, 208, 182, 183, 192

[56] References Cited

U.S. PATENT DOCUMENTS

| | | | |
|---|---|---|---|
| 3,004,230 | 10/1961 | Levinsohn | 336/223 |
| 3,287,795 | 11/1966 | Chambers et al. | 336/65 |
| 3,732,514 | 5/1973 | Sato | 336/223 |
| 3,832,661 | 8/1974 | Sato | 336/223 |
| 4,549,158 | 10/1985 | Mitsui et al. | 336/83 |
| 4,583,068 | 4/1986 | Dickens et al. | 336/83 |
| 4,616,205 | 10/1986 | Praught et al. | 336/65 |
| 4,641,114 | 2/1987 | Person | 336/200 |
| 4,769,625 | 9/1988 | Meindl | 336/65 |

FOREIGN PATENT DOCUMENTS

| | | | |
|---|---|---|---|
| 2476898 | 2/1980 | France . | |
| 2035706 | 10/1979 | United Kingdom . | |
| 2163603 | 2/1986 | United Kingdom | 336/200 |

OTHER PUBLICATIONS

"Voltage Resonant Buck-Boost Converter Using Multi-Layer-Winding Transformer" by Masahito Shoyama, K. Harada, H. Saen and M. Moriya, PESC '89 Record 20th Annual IEEE Power Electronics Specialist Conference, pp. 895-901.

*Primary Examiner*—Thomas J. Kozma
*Attorney, Agent, or Firm*—A. G. Steinmetz

[57] ABSTRACT

A magnetic component (i.e. inductor or transformer) utilizes sheet winding patterns designed to enhance component assembly and maximize utilization of the core window areas. The windings are obtained from a copper sheet from which sheet winding patterns are obtained by etching, stamping or cutting the copper sheet. These winding patterns are contoured to fit precisely into the window area of the core of the magnetic component so that the window area is fully utilized. Basic symmetrical copper sheet patterns are used and these are sequentially stacked and combined to achieve multiple turn windings. These assembled winding components are connected to a bobbin which includes pins at its periphery to interconnect the copper sheet winding patterns to obtain the desired number of turns of the windings.

The bobbin structure supports the component on a circuit board with the magnetic core of the component protruding through an aperture in the printed circuit board in order to permit a low profile mounting for the component.

3 Claims, 6 Drawing Sheets

MULTIPLE TURN LOW PROFILE MAGNETIC COMPONENT USING SHEET WINDINGS

This invention relates to magnetic components and in particular to the winding structure of a magnetic component.

BACKGROUND OF THE INVENTION

Static magnetic components such as inductors and transformers have traditionally been constructed using windings of ordinary conducting wire having a circular cross section. This arrangement normally produces a structure having dimensions that are substantial in all three dimensions as contrasted to other components such as capacitors and semiconductor devices which frequently have a small third dimension (height). Manufacture of these traditional structures involves winding the wire around a core or bobbin structur, a process that often involves considerable amounts of expensive hand labor. Furthermore high power applications often require a magnetic component having a bulky core and large wire sizes for the windings.

New operational requirements with respect to circuit size and power density and increasing necessity to reduce circuit manufacturing costs have made the traditional static magnetic component very unattractive as circuit components. Newly designed circuits, for example, need low profiles to accommodate the decreasing space permitted to power circuits. Attaining these objectives has required the redesign of magnetic components to achieve a low profile and a low cost component assembly.

An example of a presently available magnetic component with a low profile and low assembly costs is disclosed in U.S. Pat. No. 4,583,068. In this arrangement a ribbon winding is used for inductor applications and a winding with a channel shaped cross section is used as a first winding for transformer applications with the second winding being of conventional wire placed within the channel shaped cross section of the first winding. In this arrangement the first winding is limited to one turn. An arrangement using two juxtaposed windings, each of which has a channel shaped cross section, is shown in U.S. Pat. No. 4,616,205. This arrangement allows a two turn first winding.

These arrangements while a considerable improvement over traditional construction of magnetic components still fail to meet the performance and cost objectives of contemporary circuit designs.

SUMMARY OF THE INVENTION

A magnetic component (i.e. inductor or transformer), in accord with the invention, utilizes sheet winding patterns designed to enhance component assembly and maximize utilization of the core window areas. The sheet winding patterns are obtained from a copper sheet from which sheet winding patterns are obtained by etching, stamping or cutting the copper sheet. These sheet winding patterns are patterned to fit precisely into the window area of the core of the magnetic component so that the window area is substantially fully utilized. Basic symmetrical copper sheet patterns are used and these are sequentially stacked and combined to achieve multiple turn windings. These assembled winding components are connected to a bobbin which includes pins at its periphery to interconnect the copper sheet winding patterns to obtain the desired number of turns of the windings and to facilitate connecting the component to a circuit.

The bobbin structure supports the component on a circuit board with the magnetic core of the component protruding through a cutout in the printed circuit board in order to permit a low profile mounting for the component.

DETAILED DESCRIPTION

Figure 1:
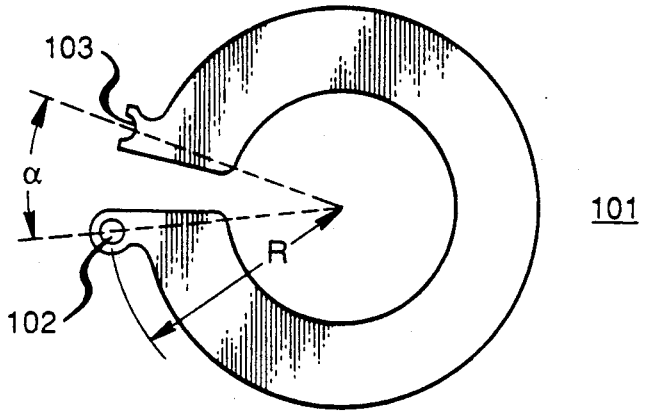
FIGS. 1, 2 and 3 depict various copper sheet winding patterns used in the winding arrangement of a magnetic component according to the invention.
Figure 2:
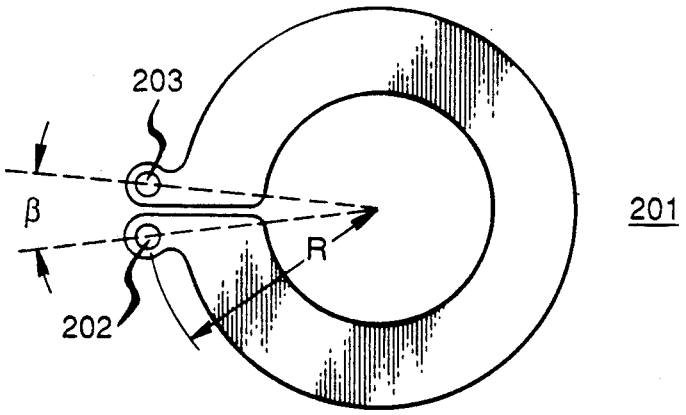
Figure 3:
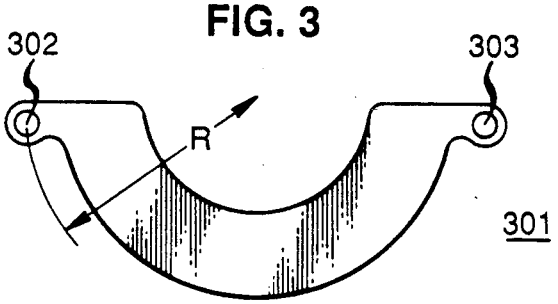
Figure 4:
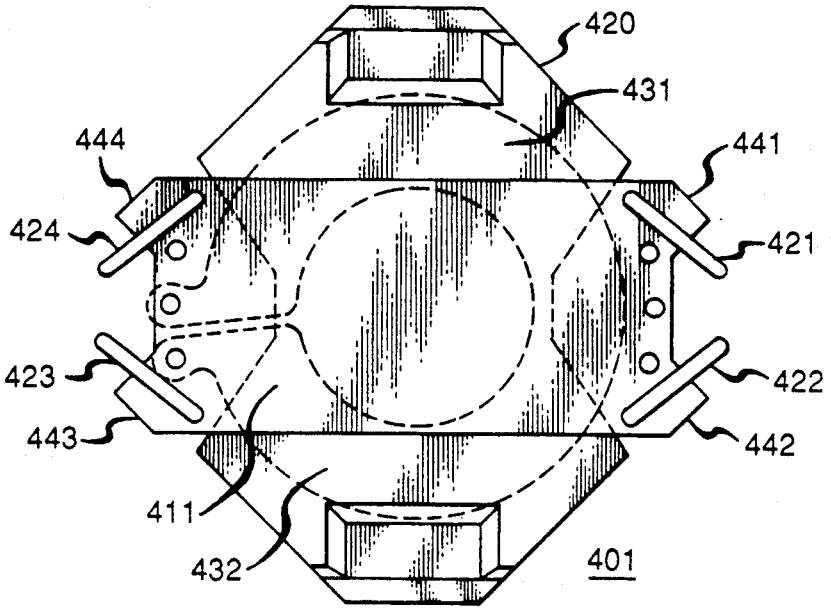
FIGS. 4 shows a plan view of a magnetic component structure according to the invention with a single turn winding illustratively included in the component structure.
Figure 5:
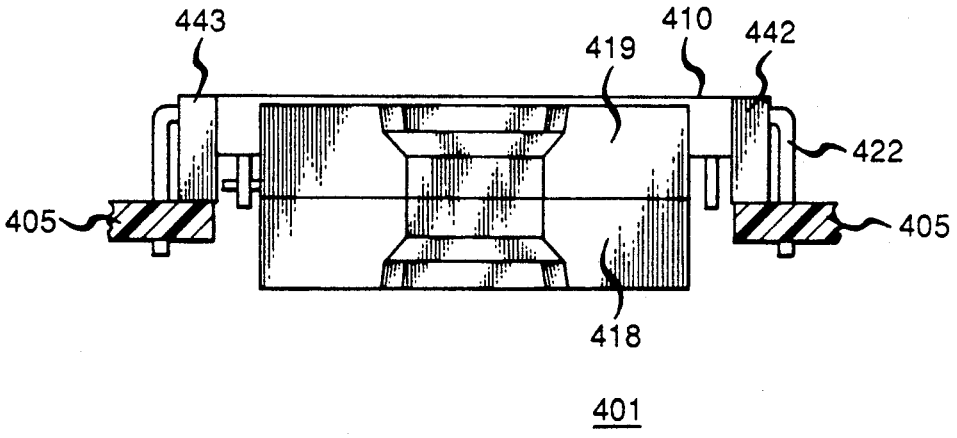
FIG. 5 shows an elevation view of the magnetic component structure shown in FIG. 4 with the single turn winding included therein according to the invention.

Various sheet winding patterns, intended for application as inductor and transformer windings in the magnetic component shown in FIGS. 4 and 5, are shown in FIGS. 1, 2 and 3. These sheet winding patterns are intended to be illustrative and are not intended to limit the invention to these particular patterns. Many other patterns will suggest themselves to those skilled in the art without departing from the spirit and scope of the invention. In each sheet winding pattern connection to other windings and to end terminals to connect with a circuit is made through conducting pins which pass through holes or semi-circular cutouts in the terminal end portions of each sheet winding pattern. These holes are dimensioned to coincide with pins included in the bobbin of the magnetic structure (shown in FIG. 4 421–423) and positioned on a circle defined by a circular loci, portions of which are included within the periphery of the magnetic component. An angular separation of the holes or semi-circular cutouts of different sheet patterns is dimensioned to correspond to various angular separations of the various pins located on the circular loci.

An angular separation $\alpha$ between a hole 102 and a semicircular cutout 103 in the sheet winding pattern 101 shown in FIG. 1 is designed to connect to two non-adjacent pins affixed to the component bobbin (shown in FIG. 4) having a single intervening pin between the two connecting pins. The inner and outer periphery or contour of the sheet winding pattern is designed to closely fit within the core windows of the magnetic component (shown in FIG. 4) to obtain a high filling coefficient and hence maximize the efficiency of flux linkage with the core.

The sheet winding pattern 201 shown in FIG. 2 has a smaller angular separation $\beta$ between the two holes 202 and 203 and is intended to connect to two adjacent pins affixed to the component bobbin (shown in FIG. 4). Its contour is also designed to closely fit within the core windows of the magnetic component (shown in FIG. 4) to obtain the desired high filling coefficient. While sheet winding pattern 101 is shown with one hole and a semicircular cutout it just as well could contain two holes for pin connections as does sheet winding 201 or in the alternative two cutouts.

A half turn sheet pattern winding 301 is shown in FIG. 3. This sheet winding pattern has its connecting holes 302 and 303 arranged to connect to pins on opposite sides of the bobbin to provide a half turn to the winding.

A magnetic component 401 adapted to use windings such as shown in FIGS. 1, 2 and 3 is shown in a plan view in FIG. 4. An elevation depicting the component mounted on a circuit substrate 405 is shown in FIG. 5. A bobbin 410 supports at least a first sheet winding 411 and includes a pinout arrangement including the pins 421–424, 426–430 and 433 for facilitating the interconnection of the sheet winding patterns to each other to form a desired winding and to further facilitate connecting the windings to circuitry on the circuit board or substrate 405 on which the component 401 is to be mounted. These pins shown in FIG. 4 are not fully reproduced in FIG. 5 so that the view presented is not unduly cluttered.

The bobbin 410 includes four support members 441–444 which rest on the circuit board 405 and hence provide support for the component. As shown, the support members 441–444 permit the mounting of the component in an aperture or opening in the circuit substrate so that the component has approximately half of its height below the top surface of the circuit substrate 405, thereby maintaining a low profile for the component 401.

The magnetic core 420 in the illustrative example is made of a ferrite material and comprises two component parts; a base structure 418 and a cover structure 419. The invention is not limited to this ferrite magnetic core material since many alternatives will be obvious to those skilled in the art. The core windows, 431 and 432 through which the windings pass, have a path or route comprising a circular segment. The inner and outer radii of these circular segments defining the windows are closely matched to the inner and outer radii of the sheet winding patterns so that they substantially fill the windows.

Figure 8:
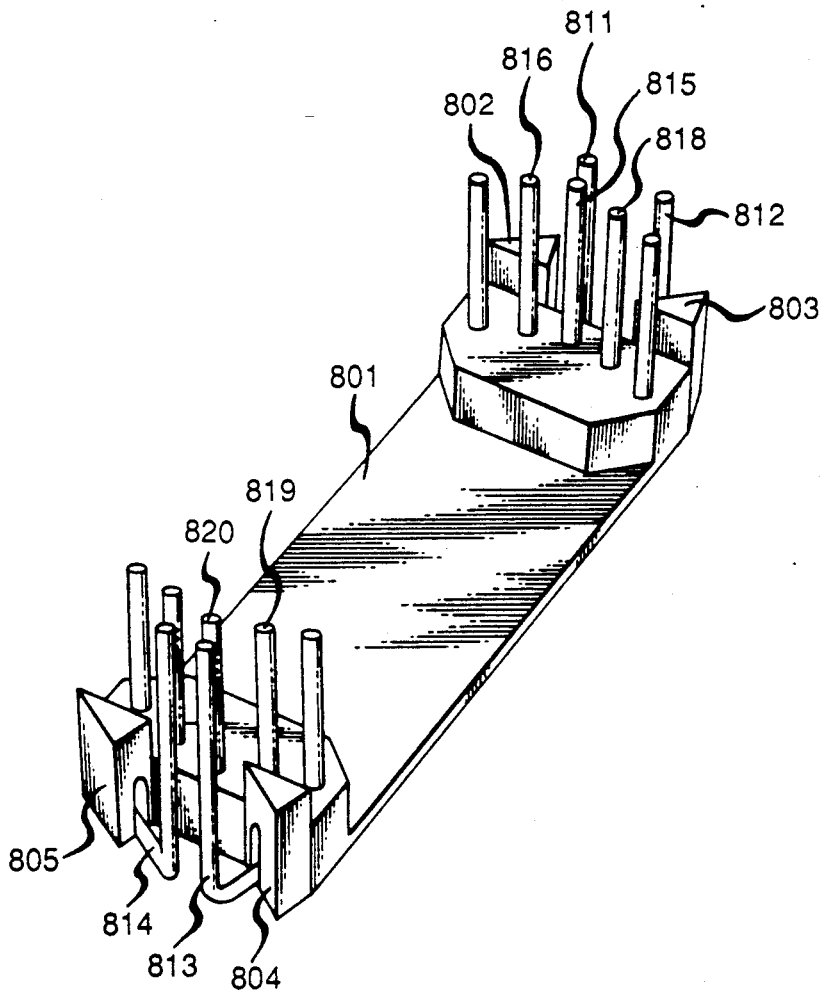
FIG. 8 shows a perspective view of a bobbin structure for the magnetic component according to the invention.

A perspective view of another illustrative bobbin structure is shown in FIG. 8. It includes a base member 801 with support members 802–805 for supporting the magnetic component on the circuit substrate adjacent the substrate opening. Conductive pins 811–820 are included in the bobbin at each end. Pins 811–814 are U shaped and are moulded into the bobbin so as to be adapted for facilitating interconnection of winding pattern sheets with a circuit path on the circuit substrate. The inner pins 816–820 are for interconnecting the winding pattern sheets to each other in order to form a winding. While a particular number and position of pins is presented in FIG. 8, it is to be understood that many other various pin arrangements are possible without departing from the spirit and scope of the invention. Each of the pins has at least one exposed end positioned on the loci of a circle having a radius equal to the radius R shown in FIGS. 1, 2 and 3 so that the pins and connecting holes in the sheet winding patterns are in dimension register.

Figure 6:
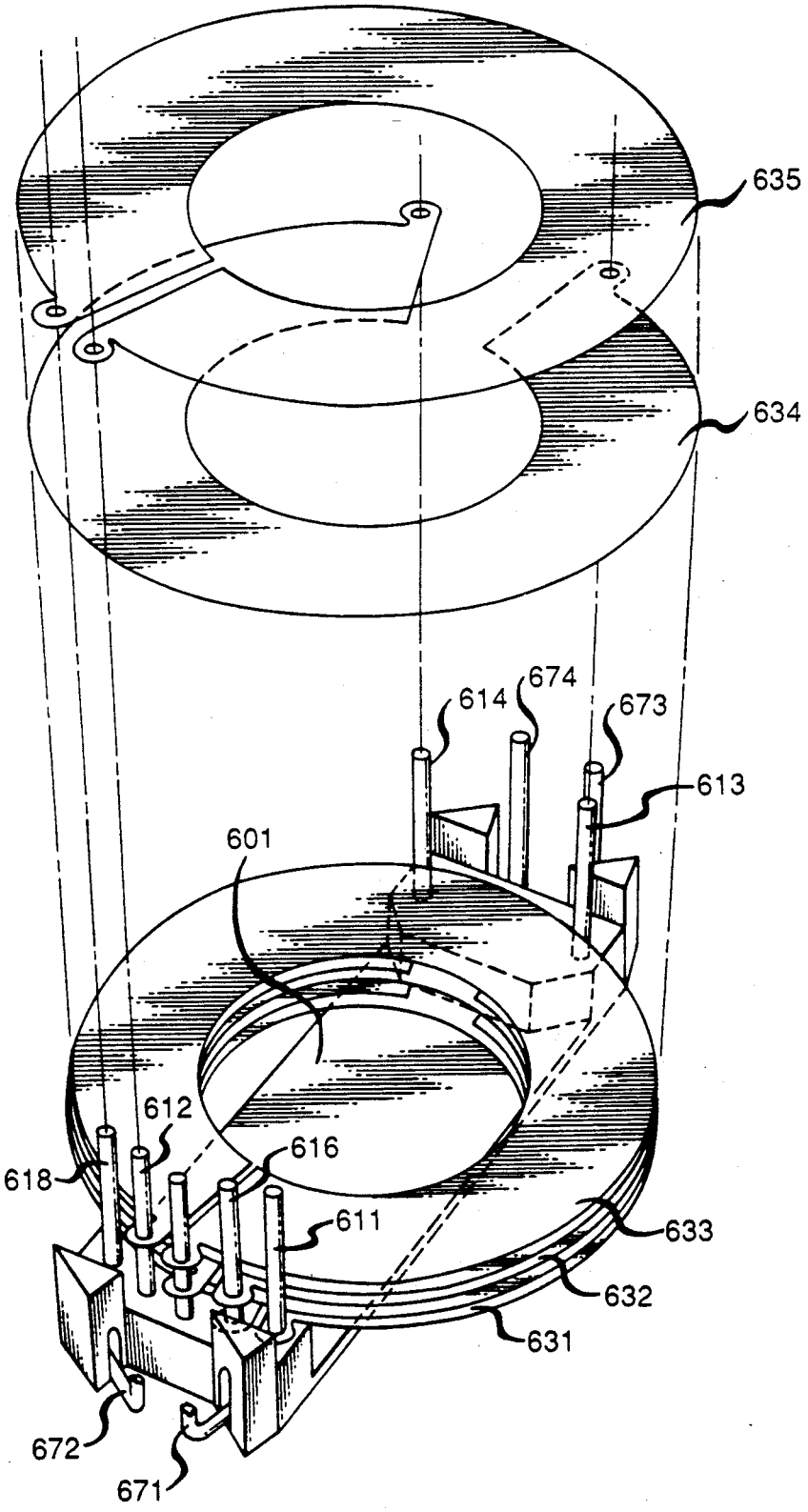
FIG. 6 shows an exploded perspective view of an arrangement of copper sheet patterns to form an illustrative multiple turn transformer winding arrangement for the magnetic component.

An understanding of the interconnection of the sheet winding patterns to the bobbin and to each other in order to form a winding can be readily ascertained by reference to the exploded perspective view of FIG. 6. The magnetic core components are omitted from this view in order to facilitate the understanding of the interconnection arrangement. A four to one winding ratio for a transformer component is disclosed in FIG. 6 as an illustrative embodiment. It is to be understood that the invention is not limited to this particular combination. Many other arrangements for both transformer and inductor components are available without departing from the spirit and scope of the invention.

A particular interconnection arrangement of the winding sheet patterns 631–635 in order to form a first winding is shown in FIG. 6. The bottom sheet winding pattern 631 has its terminal end connecting holes placed over adjacent pins 611 and 616. Pin 611 is a U shaped pin molded into the bobbin 601 having a terminal end 671 (shown truncated) to facilitate connecting the sheet winding pattern 631 to external circuitry. Pin 616 is an internal pin to facilitate the connection of sheet winding action 631 to a subsequent sheet winding pattern 632. The next winding sheet pattern 632 has its terminal end connecting holes placed over adjacent pins 616 and 617. A subsequent winding sheet pattern 633 has its terminal end connecting holes placed over adjacent pins 617 and 618. The next layered winding sheet pattern 634 has its terminal end connecting holes placed over an inner end of the U shaped pins 613 and 614. The outer terminal ends 673 and 674 connect the sheet winding pattern 634 to external circuitry. Pattern 634 represents a distinct single turn winding. The final winding sheet pattern 635 has its terminal end connecting holes placed over adjacent pins 618 and 612. The external end 672 and pin 612 are connected to the circuit board.

It is readily apparent that sheet winding patterns 631, 632, 633 and 635 are connected electrically in series and form a first transformer winding and that sheet winding pattern 634 is an independent second winding magnetically coupled to the first winding. Continuity between individual winding patterns is provided through the pin connections with each winding pattern. Connection of a winding to the circuitry of the circuit board is via the outer extension 671–674 at the U shaped pins 611–614.

Figure 7:
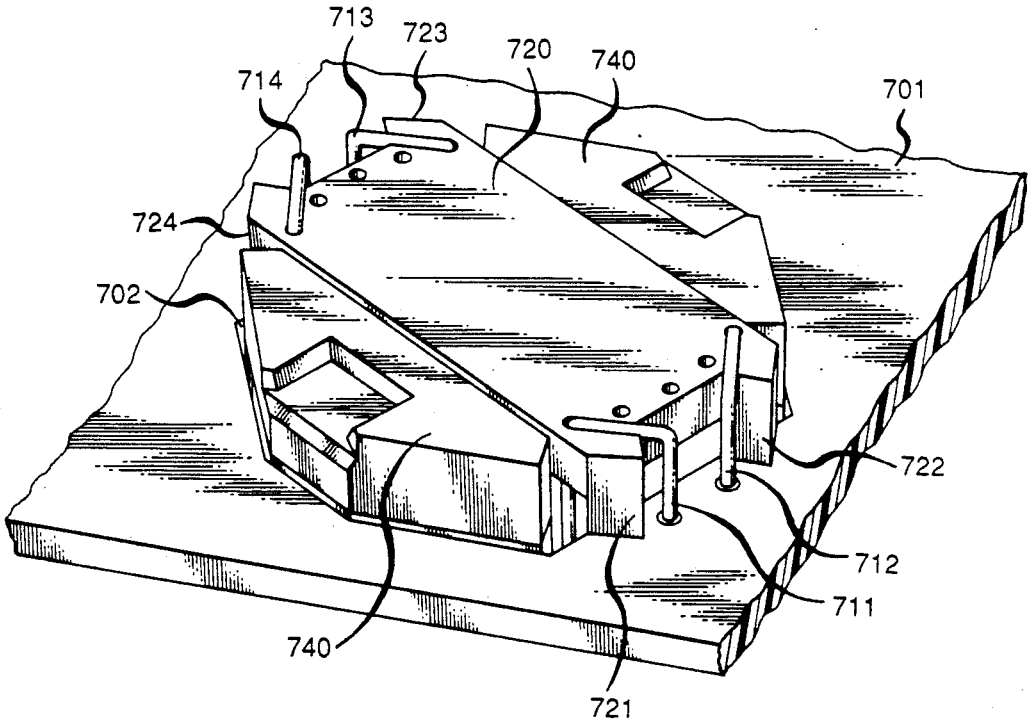
FIG. 7 shows a perspective view of a magnetic component embodying the principles of the invention mounted on a circuit board.

Mounting of the magnetic component on the circuit board or substrate 701 is shown in FIG. 7. The outer extension ends of the connecting U shaped pins 711–714 are connected to through holes in the circuit substrate 701. The four support members 721–724 of the bobbin 720 rest on the surface of the circuit substrate and the magnetic core 740 fits partially through an opening 702 in the circuit substrate 701, so that a low profile may be achieved.

Figure 9:
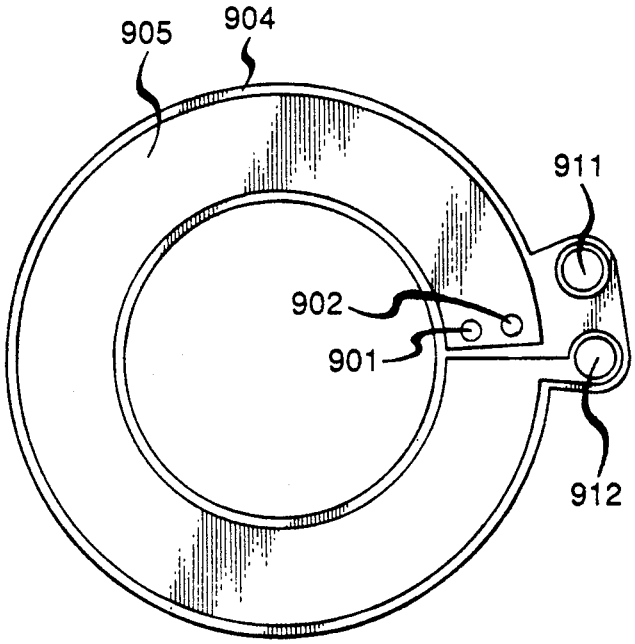
FIG. 9 shows a winding pattern etched on a flex substrate.

Another construction of a sheet winding pattern is disclosed in FIG. 9. The pattern disclosed therein comprises a copper pattern 905 etched on a thin flexible substrate 904 having copper plated through holes 901 and 902. The plated through holes 901 and 902 permit the coupling of two stacked winding patterns. Many additional windings may be devised to achieve additional multiple turn winding constructions. In FIG. 9 a two turn winding with identical copper patterns on both the top side (shown) and the bottom side of the flexible substrate is disclosed. The individual windings are connected through the plated through holes 901 and 902. The first winding is applied to the underside of the flex substrate and connected to pin hole 911. This underside copper pattern is connected to the top copper pattern 905 via the plated through holes 901 and 902. The output of the two turn arrangement is via the pin hole 912.1.

I claim:

1. In combination:

a circuit substrate for accepting electrical components and including at least an aperture for allowing a mounted component to penetrate a plane of the circuit substrate;

the circuit substrate including a plurality of through holes, near the periphery of the aperture, for accepting pin connections;

a magnetic component mounted within the aperture with a portion of the magnetic component above the plane of the circuit substrate;

the magnetic component comprising:

a core of magnetic material having first and second windows with a longitudinal path for windings in each of the first and second windows, each longitudinal path following a circular course of identical radius and traversing an equal arc;

at least a first and second conducting sheet winding mounted as successive layers in the first and second windows and having a circular profile and substantially filling the first and second windows;

each conducting sheet winding having first and second terminal ends, at least one of said first and second terminal ends having a hole suitable to accept penetration of and connection to a conducting pin;

a support bobbin including:

a central open area having a flat planar support plane for accepting the core of magnetic material and the first and second sheet windings traversing the first and second windows;

a plurality of first type and second type connecting pins, the first type connecting pins for interconnecting the first and second sheet windings by passing through the holes of the sheet windings, and the second type of connecting pins electrically connected to selected ones of the first type of connecting pins and positioned to insert into the through holes so as to electrically connect the windings to the circuit substrate; and a plurality of support members positioned outside the outside periphery of the core and resting on portions of the circuit substrate near the periphery of the aperture for supporting the bobbin and its associated core of magnetic material and the first and second sheet windings in structure with the circuit substrate.

2. In the combination as claimed in claim 1, wherein the first and second sheet windings have one of their respective first and second terminal ends connected to a common first type connecting pin so that the first and second sheet windings are connected in series to form a multiple turn winding.

3. A circuit substrate having a magnetic component mounted thereon;

comprising:

an aperture penetrating a plane of the circuit substrate and having dimensions allowing full penetration thereof by the magnetic component;

the magnetic component comprising:

a core of magnetic material having first and second windows with a path in each the first and second window traversing an equal arc of the same annular locus;

a first and second conducting winding each having an annular shape and a substantially flat cross section and filling the first and second windows, and each including first and second terminal ends and at least one of said first and second terminal ends having a hole suitable to accept penetration of and connection to a conducting pin;

a support bobbin including:

a central open area having a flat planar support plane for accepting the core of magnetic material and the first and second sheet windings traversing the first and second windows;

a plurality of first type and second type connecting pins, the first type connecting pins for interconnecting the first and second sheet windings by passing through the holes of the sheet windings, and the second type of connecting pins electrically connected to selected ones of the first type of connecting pins and positioned to insert into the through holes so as to electrically connect the windings to the circuit substrate; and a plurality of support members positioned outside the outside periphery of the core and resting on portions of the circuit substrate near the periphery of the aperture for supporting the bobbin and its associated core of magnetic material and the first and second sheet windings in structure with the circuit substrate; and the first type conducting pins connected to the holes of the sheet windings to form a winding.

* * * * *